US009925409B2

(12) United States Patent
Kürthy et al.

(10) Patent No.: US 9,925,409 B2
(45) Date of Patent: Mar. 27, 2018

(54) APPARATUS FOR STRENGTHENING ARM MUSCLES

(71) Applicant: PÁN-TRADE Kft., Budapest (HU)

(72) Inventors: István Kürthy, Budapest (HU); Istvüa n Kürthi, Budapest (HU)

(73) Assignee: PÁN-TRADE Kft. (HU)

( * ) Notice: Subject to any disclaimer, the term of this patent is extended or adjusted under 35 U.S.C. 154(b) by 245 days.

(21) Appl. No.: 14/888,918

(22) PCT Filed: May 3, 2014

(86) PCT No.: PCT/HU2014/000037
§ 371 (c)(1),
(2) Date: Nov. 3, 2015

(87) PCT Pub. No.: WO2014/177896
PCT Pub. Date: Nov. 6, 2014

(65) Prior Publication Data

US 2016/0082305 A1 Mar. 24, 2016

(30) Foreign Application Priority Data

May 3, 2013 (HU) ..... 1300280

(51) Int. Cl.
*A63B 21/06* (2006.01)
*A63B 21/00* (2006.01)
(Continued)

(52) U.S. Cl.
CPC ..... *A63B 21/159* (2013.01); *A63B 21/00069* (2013.01); *A63B 21/06* (2013.01);
(Continued)

(58) Field of Classification Search
CPC ..... A63B 21/152; A63B 21/159; A63B 21/06; A63B 21/4035; A63B 23/129;
(Continued)

(56) References Cited

U.S. PATENT DOCUMENTS 4,068,843 A 1/1978 Frost
4,176,837 A * 12/1979 Jeffrey ..... A63B 21/28 194/239

(Continued)

FOREIGN PATENT DOCUMENTS

KR 20100107923 A 10/2010

OTHER PUBLICATIONS

Borras Gonzales, E., Authorized Officer, European Patent Office, "International Search Report" in connection with related International Application No. PCT/HU2014/000037, dated Sep. 25, 2014, 5 pages.

(Continued)

*Primary Examiner* — Gregory Winter
(74) *Attorney, Agent, or Firm* — Kolisch Hartwell, P.C.

(57) ABSTRACT

An apparatus for strengthening arm muscles, including a framework, a tabletop on the framework, an elbow pad and a touch pad on the tabletop. A hinged lever with a handle is coupled to a horizontal shaft, which in turn is coupled to a vertical shaft. A grooved wheel is disposed on the vertical shaft under the tabletop, and a wire is laid in the groove of the wheel. One end of the wire is fixed to the wheel and the other end of the wire is detachably fixed to a counterbalance weight, so that when the counterbalance weight is in a lower extreme position, the lever is in an initial position, and when the lever is in a reclined position, the counterbalance weight is in an elevated position relative to its lower extreme position.

18 Claims, 4 Drawing Sheets

Figure 1:
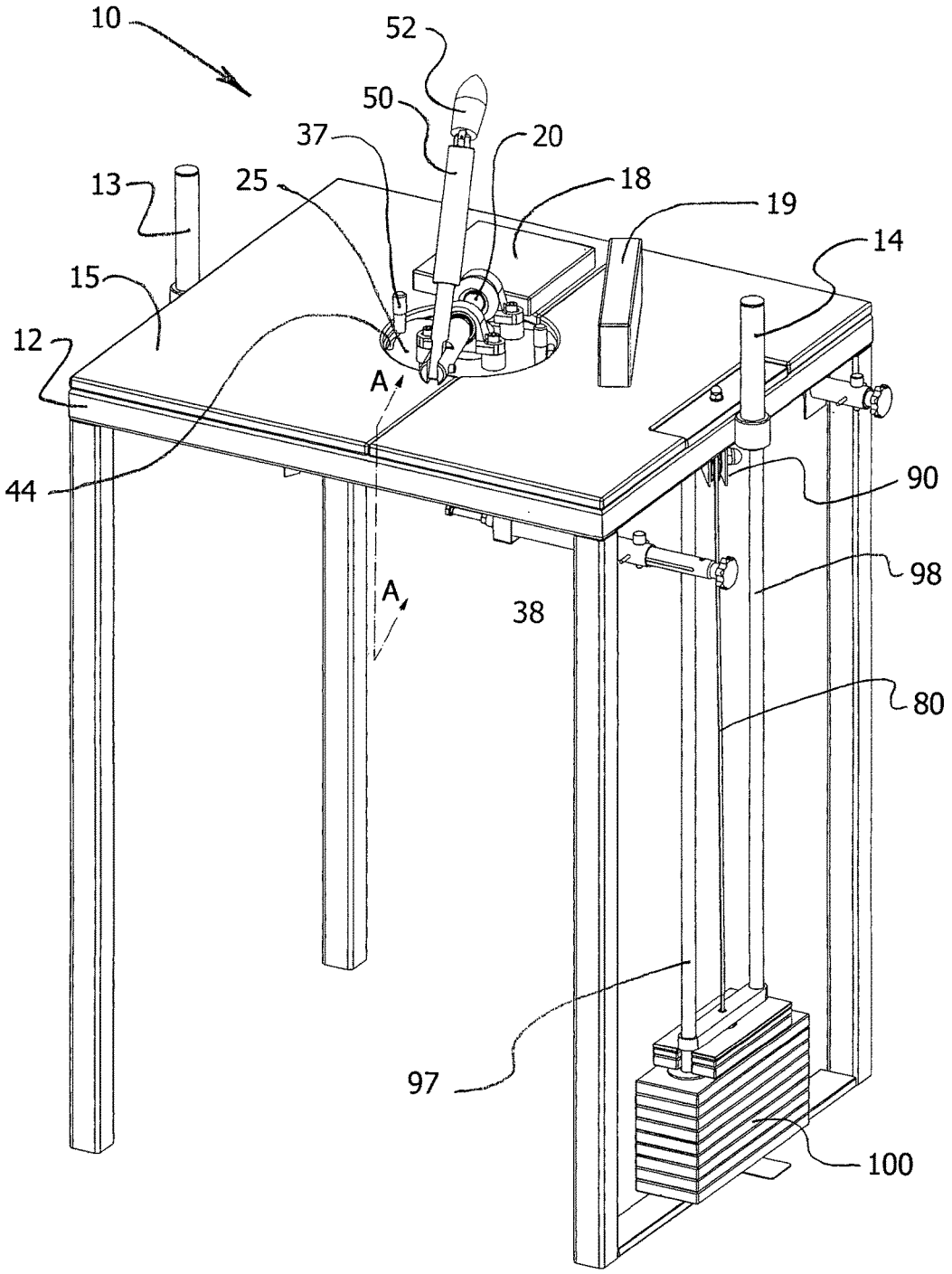

(51) Int. Cl.

| | |
|---|---|
| ***A63B 71/06*** | (2006.01) |
| ***A63B 23/035*** | (2006.01) |
| ***A63B 23/12*** | (2006.01) |
| ***A63B 21/062*** | (2006.01) |

(52) U.S. Cl.
CPC ..... *A63B 21/0628* (2015.10); *A63B 21/152* (2013.01); *A63B 21/4035* (2015.10); *A63B 21/4047* (2015.10); *A63B 23/03508* (2013.01); *A63B 23/129* (2013.01); *A63B 71/0619* (2013.01); *A63B 2071/0625* (2013.01); *A63B 2208/0233* (2013.01); *A63B 2225/09* (2013.01)

(58) Field of Classification Search
CPC ..... A63B 21/4047; A63B 21/0628; A63B 21/00069; A63B 21/0615; A63B 21/062; A63B 21/0626; A63B 21/151; A63B 21/155; A63B 21/28; A63B 21/285; A63B 23/03508; A63B 23/1245; A63B 23/1254; A63B 23/1272; A63B 2208/0233; A63B 71/0619; A63B 2225/09; A61H 2201/1635; A61H 2205/06
See application file for complete search history.

(56) References Cited

U.S. PATENT DOCUMENTS

| | | | | |
|---|---|---|---|---|
| 4,203,593 | A * | 5/1980 | Coppelman ..... | A63B 21/154 482/908 |
| 4,406,454 | A | 9/1983 | Dean | |
| 4,482,149 | A | 11/1984 | Weldon | |
| 4,805,900 | A | 2/1989 | Sapp | |
| 4,811,944 | A | 3/1989 | Hoff | |
| 4,957,281 | A * | 9/1990 | Christolear, Jr. .... | A63B 21/155 482/100 |
| 5,087,031 | A | 2/1992 | Hoff | |
| 9,314,657 | B2 * | 4/2016 | Martinez ..... | A63B 21/0428 |
| 2004/0023763 | A1 | 2/2004 | Sleiman | |

OTHER PUBLICATIONS

Borras Gonzales, E., Authorized Officer, European Patent Office, "Written Opinion of the International Searching Authority" in connection with related International Application No. PCT/HU2014/000037, dated Sep. 25, 2014, 5 pages.

* cited by examiner

APPARATUS FOR STRENGTHENING ARM MUSCLES

The invention relates to an apparatus for strengthening arm muscles, which apparatus, due to its construction, is applicable, without the need for another person, for strengthening arm muscles, training, competition as well as rehabilitation after recovery following muscular injuries.

It is known that competition tables used in arm wrestling competitions include frames mounted on legs and tabletop fixed on the frame, furthermore touch pads and elbow pads arranged on the tabletop as well as handgrips located on the two sides of the table and fixed to the frame. The height of competition tables, the size of the tabletop, the location of the two elbow pads and two touch pads and the size of the latter ones, furthermore the location and the size of the two handgrips are specified in order to possibly standardize the competition conditions of the wrestlers having different lower arms.

It is known the arm exercising apparatus described in U.S. Pat. No. 4,811,944 and its improvement U.S. Pat. No. 5,087,031 which has a horizontal torque-transmitting shaft where the shaft is axially unslideably and pivotally mounted to a sleeve which is fixed on the bearing area. It contains a lever which is fixed to one end of the torque-transmitting shaft and which lever is equipped with a handle and which lever is fashioned with a rod and a sleeve which sleeve is fixable in steps and is connected slideably and rotateably to that rod, wherein that lever is hinged to the torque-transmitting shaft. On the other end of the horizontal torque-transmitting shaft there is a grooved disc fixed firmly serving as a grooved pulley. A wire is laid in the groove of the grooved pulley, one end of the wire is fixed to one point on the periphery of the pulley and there is a counterbalance weight detachably mounted on the other end of the wire, which counterbalance weight keeps the wire in vertical position.

To use the apparatus, the person doing the arm wrestling exercise has to adjust the length of the lever according to the length of his or her lower arm. In the exercising position, i.e. with elbow supported near the lever, in order to keep or move the lever, the person should apply such muscular power on the lever via the handle that the torque exerted by the person on the torque-transmitting shaft, which is the product of the muscular power and the length of the lever, equals or exceeds the torque exerted by the counterbalance weight on the torque-transmitting shaft, which is the product of the currently fixed counterbalance weight and the radius of the grooved pulley, and as such is constant or can be modified by modifying the amount of the counterbalance weight.

The exercising person completes work with the exerted muscular power by turning the lever all the way down to the limit, and by turning the grooved pulley the person lifts the counterbalance weights to a defined height. The advantage of the apparatus is that the arm strengthening exercise is executed by imitating the movement of the person's arm during a competition and by lifting a defined counterbalance weight.

The disadvantage of the described apparatus is however that though it is equipped with fixed handgrips on the left and right sides but it does not have a touchpad and elbow pad, thus it does not meet the criteria of a standard competition table and does not simulate the conditions of a competition on a competition table. Continuing, because the horizontal torque-transmitting shaft is in a support fixed firmly on the bearing area, in case of changing the arms, the exercising person has to move sideways in order to have his or her lower arm and shoulder opposite the torque-transmitting shaft, thus exercising both the left and the right arm is not possible sitting or standing in the same position, thus during exercising, the person cannot create the conditions equal or similar to those on a competition table and which meet the competition rules. Another disadvantage when changing the sides is since the position of the exercising arm and the holding position always change and since practically a former position is never repeated exactly, subsequently the labour of the muscles is always a bit different from the previous exercise, thus the exercise results on the left and the right arms can be evaluated and compared with limited accuracy. The length of the lever of the apparatus can be set only in steps, thus it cannot be adjusted exactly to the different arm lengths, furthermore the set length cannot be changed during the exercise, which can be inconvenient and can limit the movement of the arm of the exercising person, or the exercising person has to move his or her elbow sideways when turning down the lever.

Another disadvantage of the apparatus is that it is unsafe. If during exercising the handle slips out of the hand of the exercising person, the force that pulls the counterbalance weight is discontinued and the counterbalance weight start to fall down and via the torque-transmitting shaft it turns the lever backwards in a continuously accelerating manner until the counterbalance weight stops. The turning backwards reaches its starting position and keeps turning on as far as the wire lets the pulley turn, additionally, the wire can fall out the grooving. The lever equipped with the handle can cause serious injuries when whipping back, as it has happened in several cases.

A further disadvantage of the apparatus is that in order to change the arm of the exercising person, apart from relocating the anchoring of the wire on the pulley and reversing its leading direction, also the counterbalance weight have to be placed on the other side of the pulley, which takes longer time. A further disadvantage of the apparatus is that the tightness of the wire is not guaranteed in the initial position of the lever, a pre-tensioned neutral position cannot be set, which entails the risk of the wire slipping out of the grooving in the initial position. It is also a disadvantage of the apparatus that it cannot be converted into a competition table since another person cannot sit to the table because of the pulley.

The disadvantages and the imperfection of the described apparatuses made it necessary to provide an apparatus which keeps the advantages of the described apparatuses but at the same time it is free of their disadvantages.

When creating the apparatus, our aim was to construct an apparatus on which, besides meeting the criteria of the competition tables such as the touch pads and elbow pads of appropriate size, etc., arm wrestling and arm force measuring exercises can be done by lifting counterbalance weights substituting the competitor, and furthermore due to the construction of the apparatus, the risk of an accident is practically impossible.

Our aim was also to construct an apparatus which can be used by people of different arm lengths, as well as left handed and right handed people without the need of adjusting the lever. It was also required to construct an apparatus which can easily be converted into a competition table for competing with another person.

The ground of the invention is the consideration that an apparatus meets our requirements which has a lever equipped with a handle and regarding its sizes and equipment, on its one side opposite the lever meets the standards of a competition table, the lever imitates the position of the arm of the competitor being supported on the elbow pad, and furthermore which enables the adjustment of the lever to the lower arm size and the current position of the elbow of the exercising person, and the grooved wheel and the counterbalance weight are in a position which enables easy handling and do not obstruct the use of the apparatus as a competition table.

The solution to the problem according to the invention is an apparatus which comprises a framework equipped with legs, a tabletop on the framework, as well as handgrips on the two opposing sides of the tabletop fixed to the framework, furthermore, an pivotally and axially unslideably mounted horizontal torque-transmitting shaft, a pivotally hinged adjustable-length lever on one end of the shaft and a rotatably mounted handle on the other end of the lever; furthermore a grooved wheel, preferably a Bowden disc, whereas there is a torque-transmitting connection between the grooved wheel and the horizontal torque-transmitting shaft, furthermore a wire laid in the groove of the grooved wheel, one end of the wire is fixed to a point on the periphery of the grooved wheel and there is a detachably fixed counterbalance weight on the other end of the wire, whereas in the lower extreme position of the counterbalance weight the lever is in initial position and in the reclined position of the lever the counterbalance weight is in an elevated position compared to its lower extreme position.

The essence of the apparatus is that it has an elbow pad and a touch pad arranged on the tabletop, the centre line of the horizontal torque-transmitting shaft points in the direction of the elbow pad, furthermore the length of the lever is continuously adjustable and the lever is hinged to the horizontal torque-transmitting shaft at the end which is farther from the elbow pad, furthermore it has a vertical torque-transmitting shaft which is positioned transversally to the horizontal torque-transmitting shaft as well as a torque-transmitting unit with a support panel fixed to the framework, by which torque-transmitting unit the horizontal torque-transmitting shaft and the vertical torque-transmitting shaft are joined to each other through a non-slip forced coupling, whereas the horizontal torque-transmitting shaft is mounted on the support panel of the torque-transmitting unit and the vertical torque-transmitting shaft is pivotally and axially unslideably mounted on the support panel of the torque-transmitting unit, furthermore the grooved wheel is fixed under the tabletop on the vertical torque-transmitting shaft through a detachable forced coupling, and it has a direction switch fixed to the framework near the edge of the grooved wheel, whereas the wire leaving the groove of grooved wheel being pulled by the counterbalance weight is turned into vertical position by means of the direction switch, furthermore it has a buffer plate fixed on the grooved wheel, as well as a shock absorber which is fixed to the framework, and the lever is touching the touch pad in reclined position.

The grooved wheel of the apparatus can be a pulley, a grooved disc, for example a Bowden disc or a grooved spoked wheel. The wire is metal wire, in order to minimalize the elongation it is practical to use multithread twisted steel wire, so-called Bowden cable.

A properly shaped handgrip is also applicable as a handle.

In a preferred embodiment of the apparatus, the torque-transmitting unit has a driving conical gear wheel fixed on the horizontal torque-transmitting shaft, as well as a driven conical gear wheel fixed on the vertical torque transmitting shaft and joining with the driving conical gear wheel, whereas the horizontal torque-transmitting shaft is mounted on the support panel of the torque-transmitting unit in a way that the joining gear wheels are sandwiched between the mounting seats of the horizontal torque-transmitting shaft. The gear wheels are fixed on the torque-transmitting shaft with a latch or a stem coupling.

The ratio of the gear wheels is in general 1:(0,5-2), depending on the force to be exerted. The embodiment of the apparatus is preferable where the ratio between the driving conical gear wheel and the driven conical gear wheel is 1:1. The conical gear wheels can be of straight or helicoidal serration.

In a more preferable embodiment of the apparatus, the support panel of the torque-transmitting unit is fixed to the framework turnably around the centre line of the vertical torque-transmitting shaft. In another preferred embodiment of the apparatus, there is a mounting plate which is fixed on the framework and the support panel of the torque-transmitting unit is fixed on a mounting plate turnable around the centre line of the vertical torque-transmitting shaft.

The embodiment of the apparatus is preferable where the lever is telescopic, the handle is connected to the sleeve of the telescope and it is rotatable around the centre line of the sleeve. Furthermore, the embodiment of the apparatus is preferable where the direction switch is a pulley fixed with free-wheeling bearing, whereas the groove of the grooved wheel and the groove of the pulley have a common tangent line. In another embodiment the direction switch is a grooved disc fixed with free-wheeling bearing or a properly fixed pivot.

In an even more preferable embodiment of the apparatus, the horizontal torque-transmitting shaft has a shaft section connected to the lever and a shaft section connected to the vertical torque-transmitting shaft, the two shaft sections are rotatable around their common centre line and can be fixed to each other in a rotated position. This enables an easy adjustment of the starting position of the lever.

An embodiment is very preferable where there is a wire tensioning means at either end of the wire, preferably at the end which is fixed on the periphery of the grooved wheel, which enables the pre-tensioning of the wire in the starting position of the lever. Such wire tensioning means can be a screwed wire tensioning means or flexible wire tensioning means, for example rubber member or spring or a combination of these.

Furthermore, an embodiment of the apparatus is very preferable where the shock absorber has a fine adjusting bolt. Furthermore, an embodiment is preferable where there is an energy absorbing element in the shock absorber, preferably hydraulic or pneumatic working cylinder and/or spring.

The falling out of the wire from the groove of the wheel is prevented by an embodiment which has a wire guide bar fixed on the framework and/or a wire guide ring fixed on the grooved wheel.

The structural layout of the apparatus is practically such that the vertical torque-transmitting shaft is arranged in the central part of the tabletop.

Another preferred embodiment of the apparatus is in which there is a display, especially light and/or sound signal emitting circuit, in the touch pad triggered by pressure applied on the touch pad.

Figure 2:
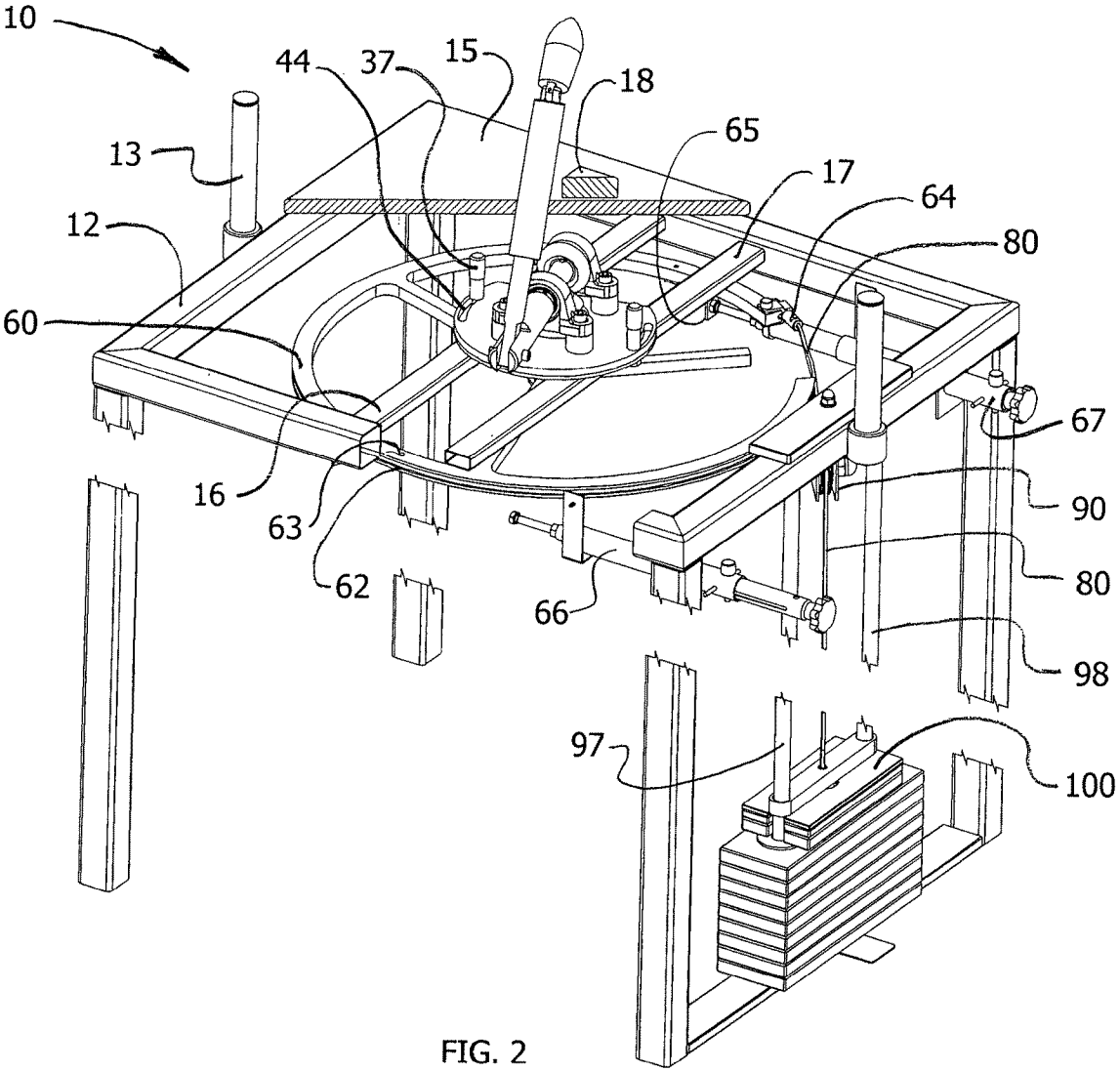
Figure 3:
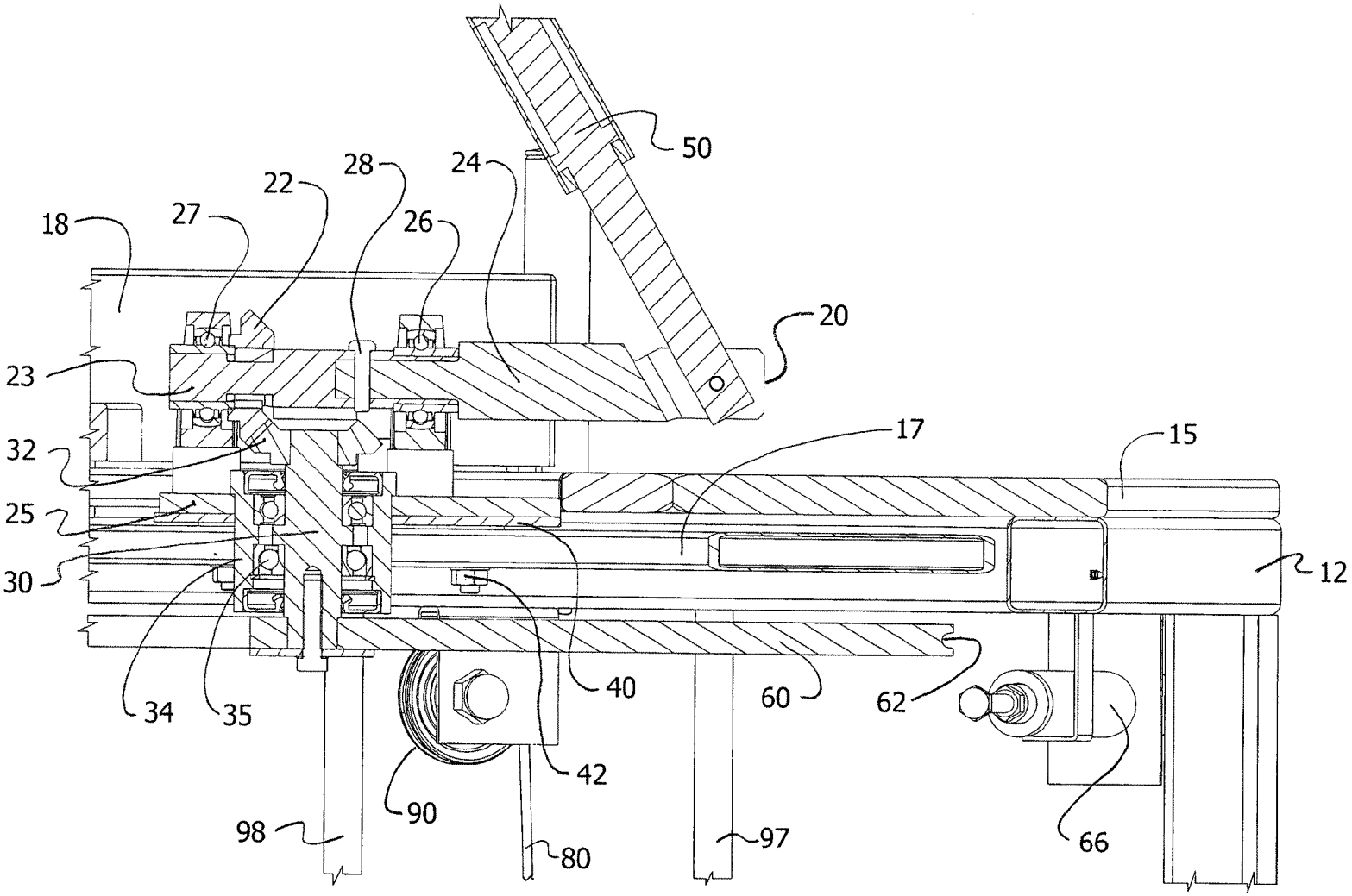
Figure 4:
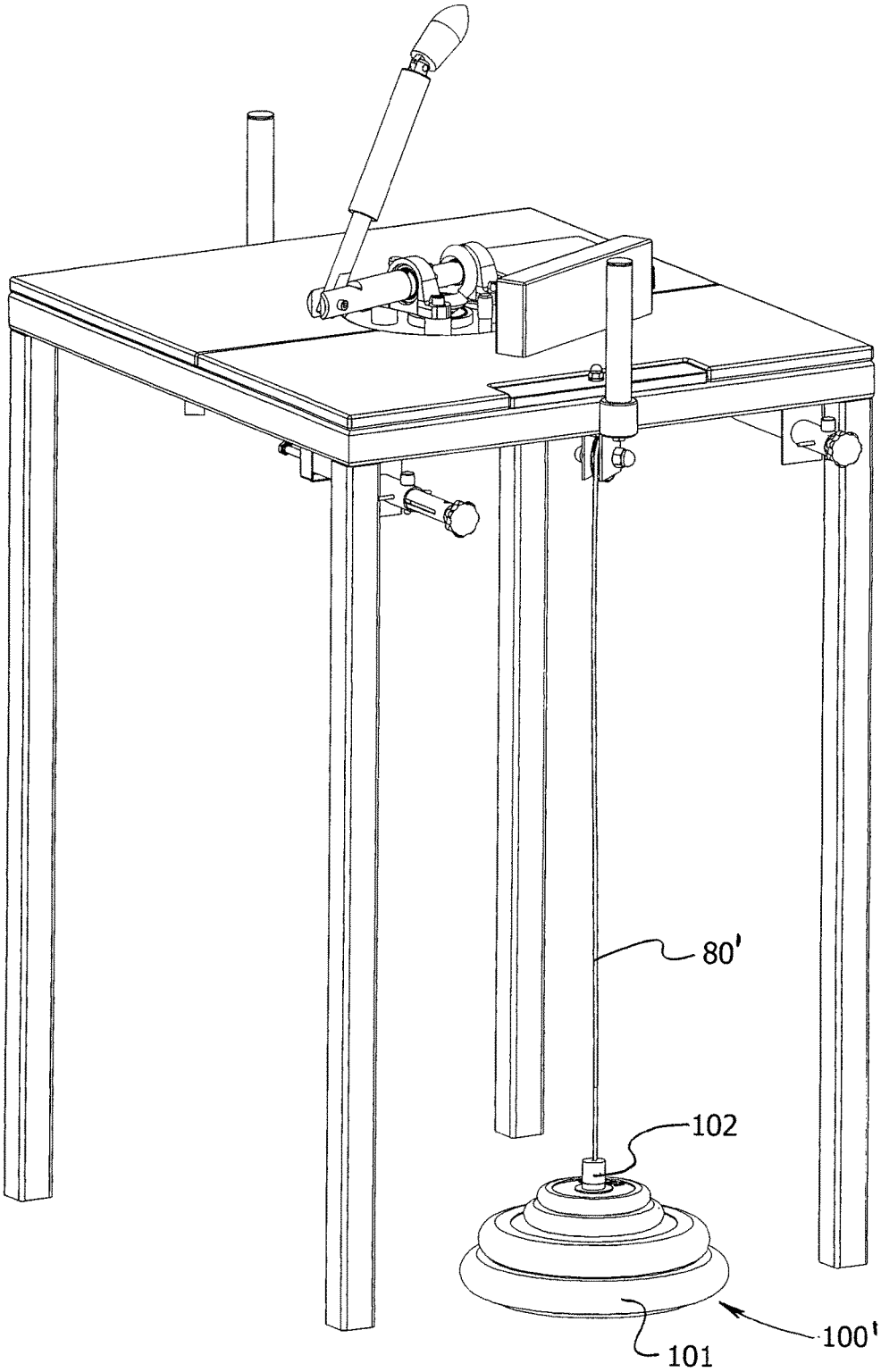

The essence of the invention is described below in more details and with reference to preferred embodiments and with reference to the attached drawings, where the FIG. 1 shows the perspective view of a first embodiment of the apparatus, the FIG. 2 shows the perspective view of the apparatus shown in FIG. 1, in a cut position of a part of the tabletop, the elbow pad, the framework, the grooved wheel and the wire, the FIG. 3 shows the inclined cross-section view of the central part of the apparatus shown in FIG. 1 in A-A plane and the FIG. 4 shows the perspective view of a second embodiment of the apparatus.

FIG. 1 shows the perspective view of a first embodiment of the apparatus 10. The apparatus 10 has a framework 12 fashioned with legs, frame and traverses 16, 17 fixed in the frame as shown in FIG. 2, it also has a tabletop 15 mounted on the framework 12, which in this embodiment is a divided tabletop 15.

On the tabletop 15 there is an elbow pad 18 and a touch pad 19 mounted and fixed to the tabletop 15 with pins for supporting the elbow of the exercising person, their position depending on exercising with right or left arm. Furthermore, on the framework 12 there are handgrips 13, 14 fixed on two opposite sides of the apparatus encircling the elbow pad 18, from which always only the one on the non-working arm's side is used. In case of exercising with the other arm, the elbow pad 18 and the touch pad 19 on tabletop 15 are repositioned to the other side of the centre line to fit the position of the exercising arm.

The apparatus 10 has a horizontal torque-transmitting shaft 20 located over the tabletop 15 and pointing to the elbow pad 18 with its centre line, to the end of the shaft 20 which is farther from the elbow pad 18 there is a lever 50 hinged to exert the muscular force of the exercising person. On the end of the lever 50 a handle 52 is connected with three-dimensional hinge to help grasp. The lever 50, as it is clearly visible in FIG. 3, is hinged to the forked end of shaft 20, thus by turning the lever 50 the horizontal torque-transmitting shaft 20 can be turned to either direction corresponding to right handed or left handed use. The lever 50 is telescopic, thus continuously adjustable length, the handle 52 is connected to the sleeve of the telescope and is rotatable around the centre line of the sleeve. Thus the lever 50 is substantially self-adjusting, it adjusts to the position of the hand and the length of the lower arm of the exercising person grasping the handle 52 and supported on elbow pad 18 with his or her elbow.

Furthermore, the apparatus 10 has a vertical torque-transmitting shaft 30, clearly visible in FIG. 3, which overrides the tabletop 15. Under the tabletop 15 on the lower end of the shaft 30 a grooved wheel 60 is fixed with a detachable forced coupling, and there is a groove 62 on the curved surface of the wheel 60. The horizontal torque-transmitting shaft 20 and the vertical torque-transmitting shaft 30 are pivotally and axially unslideably mounted in the torque-transmitting unit located in the middle part of the tabletop 15 shown in cross-section view in FIG. 3, via this unit the shafts are joined to each other through a non-slip forced coupling. Thus turning the lever 50 to either direction results in the proportional turning of wheel 60 in the corresponding direction, as it will be presented in details below.

FIG. 2 shows the perspective view of the apparatus shown in FIG. 1, whereas the tabletop 15, the elbow pad 18, the framework 12 and the wheel 60 are shown in partial cross-section view. The horizontal position of the wheel 60 under the tabletop 15 is clearly shown in the figure.

In a part of the 62 groove of the wheel 60, a wire 80 is laid, and it is fixed to a point on the periphery of the wheel 60 by means of wire tensioning means 64, in this embodiment a screwed wire tensioning means 64. Due to a better visualization, a part of the wheel 60 and a part of the wire 80 are cut. The part of the wire 80, which is led out of groove 62, near the edge of wheel 60 is driven over a direction switch fixed to the framework 12, in this embodiment a bearing pulley 90, whereas the groove 62 and the groove of the pulley 90 have a common tangent line. At the end of the wire 80 a counterbalance weight 100 is fixed.

The wheel 60 turns in either direction when used by right or left hand. At this embodiment there are two wire fixing points on the periphery of the wheel 60 but only one of them, the wire fixing point 63 is indicated, in the other wire fixing point the end of the wire 80 is fixed with the inserted wire tensioning means 64. On the wheel 60 there are separate turn limit buffer plates for each rotation direction but only one of them, the buffer plate 65 is shown in the figure, and there are two shock absorbers 66, 67, which are fixed to the framework 12. There are energy absorbing means installed in shock absorbers 66, 67, such means can be a spring, rubber block, hydraulic and/or pneumatic working cylinder, furthermore the shock absorbers have fine adjusting bolts.

The pulley 90, which is fixed to the framework 12, is seated self-adjustingly to the turning direction of the wheel 60.

Thus the counterbalance weight 100 keeps tense the section of the wire 80 between the counterbalance weight 100 and the pulley 90 in vertical position while the section between the pulley 90 and the groove 62 is kept tense substantially in horizontal position and at the same time the wheel 60 is kept tense in blocked position.

The counterbalance weight 100 in this embodiment is combined to the desired weight from cuboid shaped slab weights. A lifting spike is fixed on the end of the wire 80 and in order to lift the desired amount of weight it has a weight selecting member, which goes through or under the lower slab weight and connects to the lifting spike, for example a pin, a bolt or a fork. The counterbalance weight 100 is guided with the vertical weight guide 97, 98 fixed to the framework 12.

FIG. 3 shows the cross-section view of the central part of the apparatus. The torque-transmitting unit having a support panel 25 is clearly visible in the figure. The vertical torque-transmitting shaft 30 overrides the support panel 25 and it is pivotally and axially unslideably fixed to support panel 25, which fixing, in this embodiment, is embodied by a sleeve 34 fixed on support panel 25 and with a bearing in the sleeve 34, whereas among the bearings only the lower bearing 35 is marked with reference sign. The upper bearing is supported by a collar fashioned in the sleeve 34, the lower bearing 35 is fixed in the sleeve 34 with an unmarked Seeger ring, the axial dislocation of the shaft 30 is prevented by the encounter of a collar fashioned on the shaft 30 with the internal bearing races of the bearings. A driven conical gear wheel 32 is fixed on the upper end of the vertical torque-transmitting shaft 30, in this embodiment, with latch coupling.

The horizontal torque-transmitting shaft 20 is pivotally hinged on the support panel 25 at two places sandwiching the shaft 30, in this embodiment with bearings 26, 27 fixed in appropriate bearing boxes. The driving conical gear wheel 22 is fixed on the horizontal torque-transmitting shaft 20, in this embodiment with latch coupling. The gear wheel 22 fixed on the shaft 20 and the gear wheel 32 fixed on the shaft 30 linked together provide the non-slip forced coupling which transmits the torque between the shafts 20 and 30. The axial dislocation of the shaft 20 is prevented by a collar on the shaft 20 and the engagement of the conical gear wheels 22, 32.

The ratio of the gear wheels is adapted to the expected muscular force to be exerted and the amount of the counterbalance weight, in this embodiment it is 1:1.

The support panel 25 of the torque-transmitting unit is fixed to the traverses 16, 17 by means of a mounting plate 40. The support panel 25 is rotatable around the centre line of the shaft 30, and in this embodiment, it is releasably fixed in any given position. The mounting plate 40 is fixed on the traverses 16, 17 with bolted connection. In the support panel 25, as FIGS. 1 and 2 show, sandwiching the centre line of the shaft 30, there are two opposing grooves, their length corresponds with the desired adjustability, whereas the figures show only the groove 44. The position of the support panel 25 on the mounting plate 40, thus the position of the horizontal torque-transmitting shaft 20 relative to the centre line of tabletop 15 can be adjusted by turning the support panel 25 on the mounting plate 40. The support panel 25 is fixed to the mounting plate 40 by means of adjusting bolts 37, 38 overriding the grooves 44.

As FIG. 3 shows, the horizontal torque-transmitting shaft 20 is a composition of two shaft sections, shaft section 24 is connected to the lever 50 and ends in a pin, shaft section 23 is fixed with bearings 26, 27 and has a hole to receive the pin. The two shaft sections 23, 24 are turnable around their common centre line and they are fixable to each other in the turned position. The fixation of the shaft sections is done by shape locking and a means securing the joined position, in this embodiment by a pin 28. This embodiment enables the adjustability of the starting position of the lever 50 independently from the adjustment of the other parts of the apparatus.

FIG. 4 shows the perspective view of a second embodiment of the apparatus, which is substantially identical with the embodiment of the apparatus shown in FIG. 1. The difference is that the disc shaped counterbalance weight 100' is suspended on wire 80' without guides. The counterbalance weight 100' has a lower disc 101, in the centre of this disc 101 is a pin 102 located, the rest of the disc weights can be fastened to the pin 102 and the wire 80' is releasably fixed to the end of the pin 102.

The apparatus can be used for exercising with both right hand and left hand. Depending on whether the exercising person is right handed or left handed, the elbow pad 18 and the touch pad 19 are fixed in the corresponding position on the tabletop 15, the torque-transmitting unit is set in the appropriate direction, the wire 80 is fixed and laid in the groove 62 of the wheel 60 from the appropriate direction, and the buffer plate 65 and the shock absorber 67 of the same side work together. For using with the other arm, the elbow pad 18 and the touch pad 19 have to be repositioned on the other side of the tabletop 15, the torque-transmitting unit has to be set to the other direction, repositioning the wire 80 it has to be fixed and laid in the groove 62 of the wheel 60 from the other direction, and the buffer plate and the shock absorber of the other side work together.

In the normal position of the apparatus, the lever 50 is in starting position for exercising, in this position the buffer plate 65 of the wheel 60 hits the shock absorber 66 respectively 67 of the corresponding side. The counterbalance weight 100 is in lower extreme position and keeps the section of wire 80 exiting groove 62 onto pulley 90 substantially in horizontal and the section between pulley 90 and counterbalance weight 100 in vertical, slightly tense position. The degree of tension can be adjusted with the fine adjusting bolts on the end of shock absorber 66 respectively 67. In the other extreme position of the apparatus, the lever 50 is laid down, it is touching the touch pad 19 and it is kept in this position with muscular power. Then the wheel 60 is in turned position from the matching position, the counterbalance weight 100 is in the highest elevated position from its support and with its weight, by means of wire 80 it is pulling the wheel 60 to turn into the contacting position.

When using the apparatus, the exercising person has to be able to exert at least a defined muscular power in order to move the lever 50. If the exercising person can exert muscular power exceeding this, then by turning the lever 50, via the torque-transmitting unit the person will force the wheel 60 to turn in the direction to make the wire 80 lift counterbalance weight 100 from its support, thus the person will exert muscular power against the counterbalance weight. Since the weight of counterbalance weight 100 will not change, it is assured that the exercising person has to exert muscular power against constant torque on the lever 50. The work done by the exercising person is independent from the length of the lower arm, for an arm turn of a given angle, a person with shorter lower arm has to exert bigger force on a shorter arc, a person with longer lower arm has to exert less force on a longer arc, in both case exerting the same torque and performing the same work in both cases.

The main advantage of the apparatus is that the counterforce is given by the counterbalance weight, thus the muscular power exerted by the exercising person can always be measured objectively and is variable, this way the individual cheating can be eliminated. Another outstanding advantage is the safe usability namely if the lever slips out of the hand of the exercising person, the counterbalance weight can tug the wheel along with the lever only to the initial position because the buffer plate on the wheel hits the energy absorbing shock absorber, thus preventing the wheel and the lever from turning further, and at the same time, the counterbalance weight reaches its support thus discontinuing the counterforce. Another advantage is that due to the telescopic embodiment of the lever, users with different lower arm length can use it without special adjustment. A further advantage is that it can be used with both right and left arm.

The apparatus can be used to develop the muscles of the arms, wrists, shoulders and chest of the exercising person.

An advantage of the apparatus due to its construction is that it can be used on both sides, elbow pads and touch pads can be applied on both sides, and it can be used as a competition table if the lever along with the horizontal torque-transmitting shaft section is removed.

What is claimed:

1. An apparatus for strengthening arm muscles, comprising:

a framework equipped with legs;

a tabletop disposed on the framework;

at least two handgrips disposed on opposing sides of the tabletop and fixed to the framework;

an elbow pad and a touch pad arranged on the tabletop;

a pivotally and axially unslideably mounted horizontal torque-transmitting shaft, wherein a center line of the horizontal torque-transmitting shaft points toward the elbow pad;

a pivotally-hinged adjustable-length lever; wherein the length of the adjustable-length lever is continuously adjustable;

the adjustable-length lever is coupled at a proximal end to a first end of the horizontal torque-transmitting shaft that is farther from the elbow pad than a second end of the horizontal torque-transmitting shaft;

a rotatably-mounted handle is attached to a distal end of the adjustable-length lever;

such that when the adjustable-length lever is in a reclined position the adjustable-length lever is touching the touch pad;

a vertical torque-transmitting shaft that is positioned transversally to the horizontal torque-transmitting shaft;

a torque-transmitting unit with a support panel fixed to the framework; wherein the horizontal torque-transmitting shaft is mounted on the support panel of the torque-transmitting unit;

the vertical torque-transmitting shaft is pivotally and axially unslideably mounted on the support panel of the torque-transmitting unit; and the horizontal torque-transmitting shaft and the vertical torque-transmitting shaft are joined to each other by the torque-transmitting unit via a non-slip forced coupling;

a grooved wheel fixed under the tabletop on the vertical torque-transmitting shaft via a detachable forced coupling;

a buffer plate fixed on the grooved wheel that is configured to interact with a shock absorber that is fixed to the framework;

a torque-transmitting connection between the grooved wheel and the horizontal torque-transmitting shaft;

a wire laid in a groove of the grooved wheel, a first end of the wire being fixed to a point on a periphery of the grooved wheel, and a second end of the wire being detachably coupled to a counterbalance weight; and a direction switch fixed to the framework near an edge of the grooved wheel, configured so that as the wire extends from the groove of the grooved wheel toward the counterbalance weight, the wire is redirected into a vertical orientation;

wherein the apparatus is configured so that when the counterbalance weight is in a lower extreme position, the adjustable-length lever is in an initial position, and when the adjustable-length lever is in the reclined position, the counterbalance weight is in an elevated position relative to the lower extreme position.

2. The apparatus of claim 1, wherein the grooved wheel is a Bowden disc.

3. The apparatus of claim 1, wherein the torque-transmitting unit includes a driving conical gear wheel fixed on the horizontal torque-transmitting shaft, and a driven conical gear wheel fixed on the vertical torque-transmitting shaft and joining with the driving conical gear wheel; and wherein the horizontal torque-transmitting shaft is mounted on the support panel of the torque-transmitting unit in such a way that the driving conical gear wheel and the driven conical gear wheel are sandwiched between mounting seats of the horizontal torque-transmitting shaft.

4. The apparatus of claim 3, wherein the ratio between the driving conical gear wheel and the driven conical gear wheel is 1:1.

5. The apparatus of claim 1, wherein the support panel of the torque-transmitting unit is fixed on the framework turnably around a center line of the vertical torque-transmitting shaft.

6. The apparatus of claim 1, further comprising a mounting plate fixed on the framework, wherein the support panel of the torque-transmitting unit is fixed on the mounting plate so as to be turnable around a center line of the vertical torque-transmitting shaft.

7. The apparatus of claim 1, wherein the adjustable-length lever is telescopic, and the rotatably-mounted handle is connected to a sleeve of the telescopic adjustable-length lever and is rotatable around a center line of the sleeve.

8. The apparatus of claim 1, wherein the direction switch includes a grooved pulley fixed with a freewheeling bearing such that the groove of the grooved wheel and a groove of the grooved pulley share a common tangent line.

9. The apparatus of claim 1, wherein the horizontal torque-transmitting shaft includes a first shaft section that is connected to the adjustable-length lever and a second shaft section that is connected to the vertical torque-transmitting shaft, wherein the first and second shaft sections are rotatable around a common center line and can be fixed to each other in a rotated position.

10. The apparatus of claim 1, further comprising a wire tensioner coupled to at least one of the ends of the wire and configured to adjust the tension of the wire.

11. The apparatus of claim 10, wherein the wire tensioner is coupled to the end of the wire that is fixed on the periphery of the grooved wheel.

12. The apparatus of claim 1, wherein the shock absorber comprises an energy absorbing element.

13. The apparatus of claim 12, wherein the energy absorbing element is a hydraulic or pneumatic working cylinder arranged in the shock absorber.

14. The apparatus of claim 1, wherein the shock absorber includes a fine adjusting bolt.

15. The apparatus of claim 1, further comprising at least one of a wire guide bar fixed on the framework and a wire guide ring fixed on the grooved wheel.

16. The apparatus of claim 1, wherein the vertical torque-transmitting shaft is disposed in a central part of the tabletop.

17. The apparatus of claim 1, wherein the touch pad includes a display in the touch pad that is triggered by pressure applied to the touch pad.

18. The apparatus of claim 17, wherein the display in the touch pad includes at least one of a light-emitting or sound signal-emitting circuit.

* * * * *